United States Patent [19]

Davison

[11] Patent Number: 4,566,386

[45] Date of Patent: Jan. 28, 1986

[54] HOT INK IMPRINTER WITH SWINGING PRINT HEAD

[75] Inventor: Charles F. Davison, Brookfield, Ill.

[73] Assignee: Norwood Marking & Equipment Co., Inc., Downers Grove, Ill.

[21] Appl. No.: 556,279

[22] Filed: Nov. 30, 1983

[51] Int. Cl.[4] ..... B41F 1/08; B41F 1/46

[52] U.S. Cl. ..... 101/305; 101/295; 101/320; 101/327; 101/359

[58] Field of Search ..... 101/42, 104–108, 101/287, 288, 290, 291, 293–295, 297–302, 304, 305, 307–310, 313–320, 322–327, 331, 334, 359

[56] References Cited

U.S. PATENT DOCUMENTS

| | | | |
|---|---|---|---|
| 120,040 | 10/1871 | Coons | 101/302 |
| 176,487 | 4/1876 | Schule | 101/302 |
| 204,900 | 6/1878 | Kidder | 101/302 |
| 380,278 | 3/1888 | Curtis | 101/302 |
| 380,423 | 4/1888 | Clark | 101/302 |
| 1,271,826 | 7/1918 | Anderson | 101/316 |
| 3,636,866 | 1/1972 | Stommel | 101/22 |
| 3,724,369 | 4/1973 | Gery | 101/327 |
| 3,877,367 | 4/1975 | Norwood | 101/44 |
| 3,911,812 | 10/1975 | Flynn | 101/1 |
| 4,015,525 | 4/1977 | Shenoha | 101/333 |
| 4,323,011 | 4/1982 | Hamilton | 101/305 |
| 4,365,554 | 12/1982 | Siegal | 101/44 |
| 4,373,436 | 2/1983 | Shenoha | 101/27 |
| 4,444,108 | 4/1984 | Jenness | 101/305 |

FOREIGN PATENT DOCUMENTS

| | | | |
|---|---|---|---|
| 839358 | 4/1952 | Fed. Rep. of Germany | 101/287 |
| 696467 | 12/1930 | France | 101/298 |
| 1041072 | 10/1953 | France | 101/317 |

*Primary Examiner*—Edgar S. Burr
*Assistant Examiner*—William L. Klima
*Attorney, Agent, or Firm*—Hill, Van Santen, Steadman & Simpson

[57] ABSTRACT

A hot ink imprinter and method wherein a print head carrying marking type face is swingingly supported by a rocker arm for cyclical swinging, in one phase of which type face carried by the head effects imprinting of a workpiece, and in a second phase of which the type face is caused in the swinging of the head to roll in ink pickup relation on a rotary applicator inking roll. A pulley and timing belt arrangement may be provided for controlling swinging of the print head during rocking of the rocker arm. Another arrangement for controlling the print head swinging comprises a telescopic link mechanism.

15 Claims, 15 Drawing Figures

FIG. 13
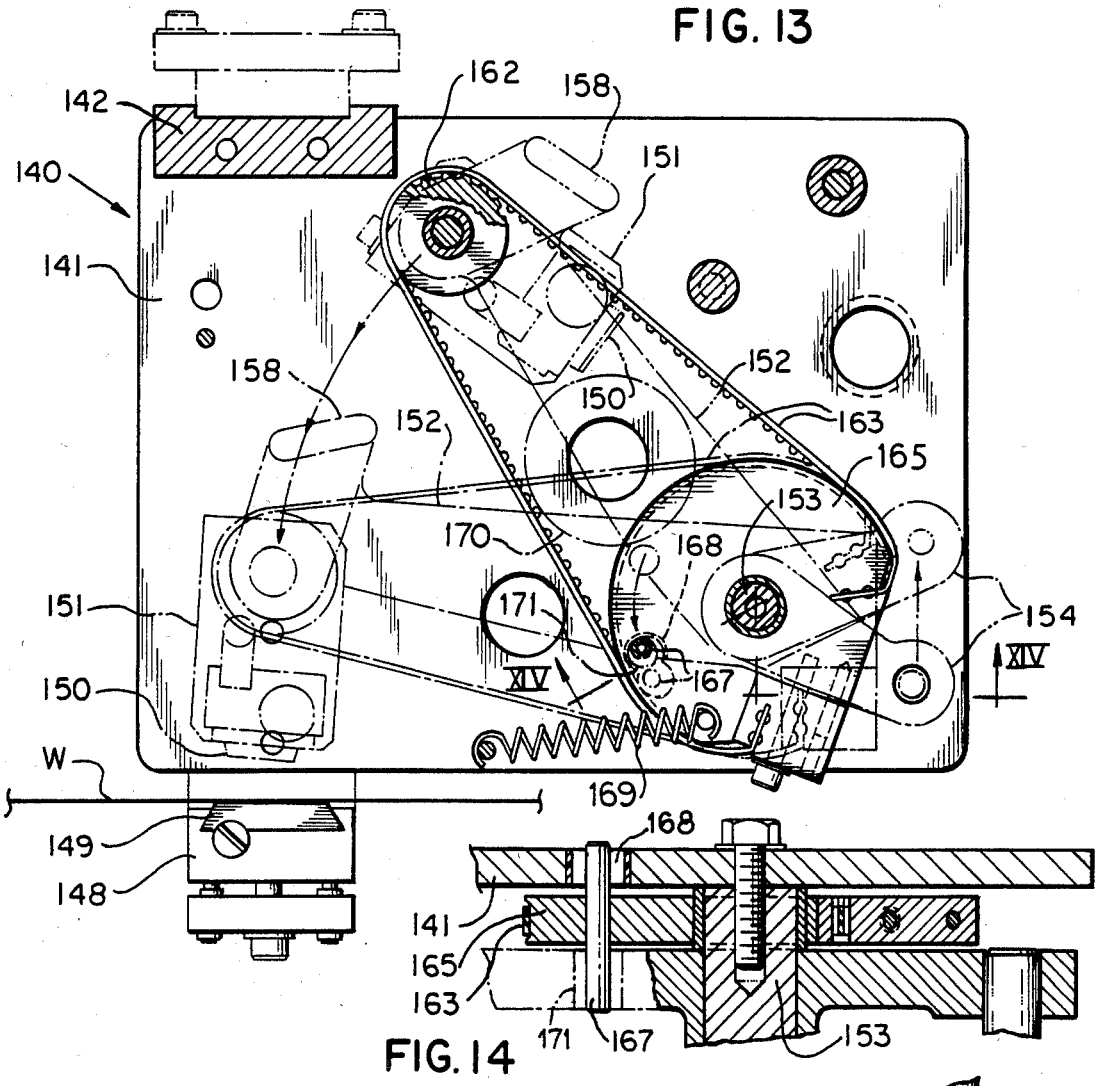
FIG. 14
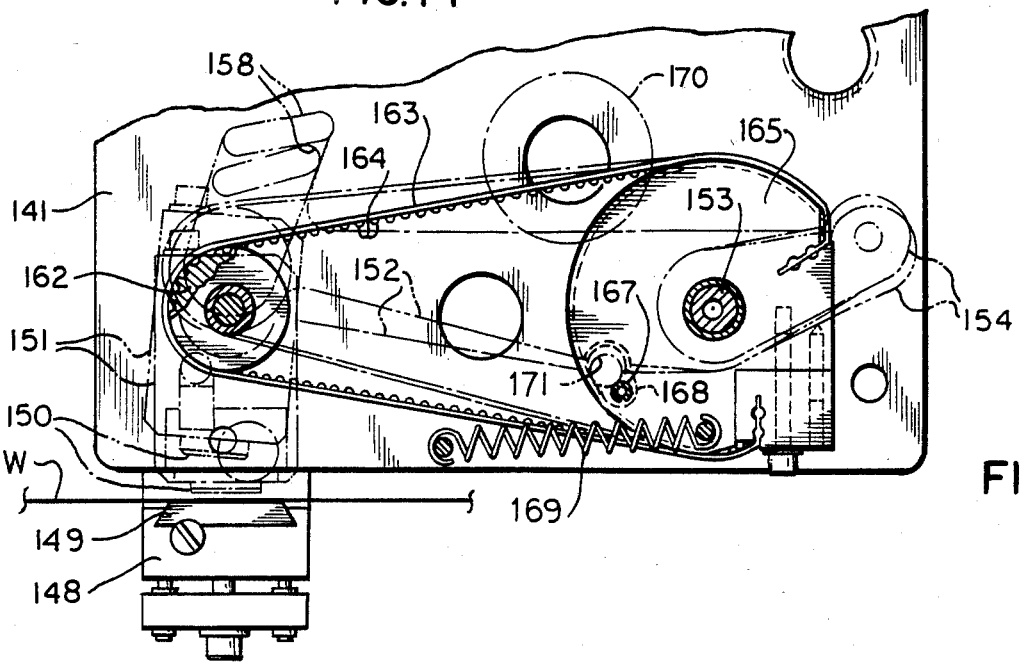
FIG. 15

HOT INK IMPRINTER WITH SWINGING PRINT HEAD

BACKGROUND OF THE INVENTION

Field of the Invention

This invention relates to marking devices or imprinters, and is more particularly concerned with a hot ink imprinter with swinging print head, especially adapted for imprinting marks on workpieces advanced in stop and go fashion.

Imprinters are used in industry for imprinting indicia on work pieces such as bag making material in strip form, and the like. For workpieces that travel continuously, rotary head imprinters have been developed. For workpieces that travel in a stop and go fashion, such as bag making material in connection with bag filling equipment, imprinters with stamping type print heads utilizing inked ribbon or transfer tape have been developed. Printers utilizing stamp pads or ink cartridges have also been developed.

Rotary head imprinters desirably utilize inking rolls impregnated with pigment or ink that is heat softenable and which will herein be referred to generically as "ink". Type carried by the rotary print head roll contacts the inking roll in each revolution of the print head for ink transfer onto the type faces. Such inking rolls have the advantage that they are usually mounted in a quick-release fashion for quick replacement or exchange as required and are especially advantageous, as compared to inked ribbon or transfer tape marking, because of the ease and speed with which changes can be made for such purposes as ink replenishment, ink color changes, and the like.

SUMMARY OF THE INVENTION

An important object of the present invention is to provide a new and improved imprinter, particularly of the hot ink type, which in a simple, efficient and economical manner adapts the use of inking roll to a generally rectilinearly operating stamping imprint marker.

Another object of the present invention is to provide a new and improved hot ink imprinter with a swinging print head operating cyclically between an ink applicator and imprinting backup means.

According to the present invention there is provided a hot ink imprinter, comprising anvil means for supporting a workpiece to be imprinted, a rotatable hot ink applicator roll, an elongate operating rocker arm mounted on a pivot at one end portion of the arm, actuator means attached to said one end portion of the arm for rocking said arm cyclically about said pivot, a print head carrying imprinting means and mounted swingably on the opposite end portion of the arm, and means operative in the rocking of the arm by the actuator means for causing the print head to swing back and forth cyclically for, in one phase of the cycle causing the imprinting means to roll on the hot ink applicator roll for applying ink to the imprinting means, and in a second phase of the cycle imprinting the workpiece on the anvil means.

The present invention also provides a hot ink imprinter, comprising a print head carrying marking means, anvil means, a rotary hot ink applicator roll spaced from the anvil means, and means for cyclically swinging the print head for ink pickup rolling engagement of the marking means with the applicator roll and then imprinting engagement of the marking means with a workpiece on the anvil means.

Further in accordance with the principles of the present invention there is provided a method of hot ink imprinting, comprising providing a swinging printing head carrying marking means, providing imprinting anvil means, and swinging the printing head cyclically comprising a first phase effecting ink pick up rolling of the marking means with a rotary hot ink applicator roll spaced from the anvil means, and in a second phase moving the print head with the inked marking means in an imprinting stroke engaging the inked marking means with a workpiece on the anvil means.

BRIEF DESCRIPTION OF THE DRAWINGS

Other objects, features and advantages of the present invention will be readily apparent from the following description of certain preferred embodiments thereof, taken in conjunction with the accompanying drawings, although variations and modifications may be effected without departing from the spirit and scope of the novel concepts of the embodiments of the disclosure, and in which:

FIG. 13 is a vertical sectional elevational view taken substantially along the line XIII—XIII of FIG. 12;

FIG. 14 is an enlarged fragmentary sectional detail view taken substantially along the line XIV—XIV of FIG. 13; and FIG. 15 is a fragmentary sectional elevational view similar to FIG. 13 but showing the print head operating means in the imprinting position thereof.

DESCRIPTION OF THE PREFERRED EMBODIMENTS

Figure 1:
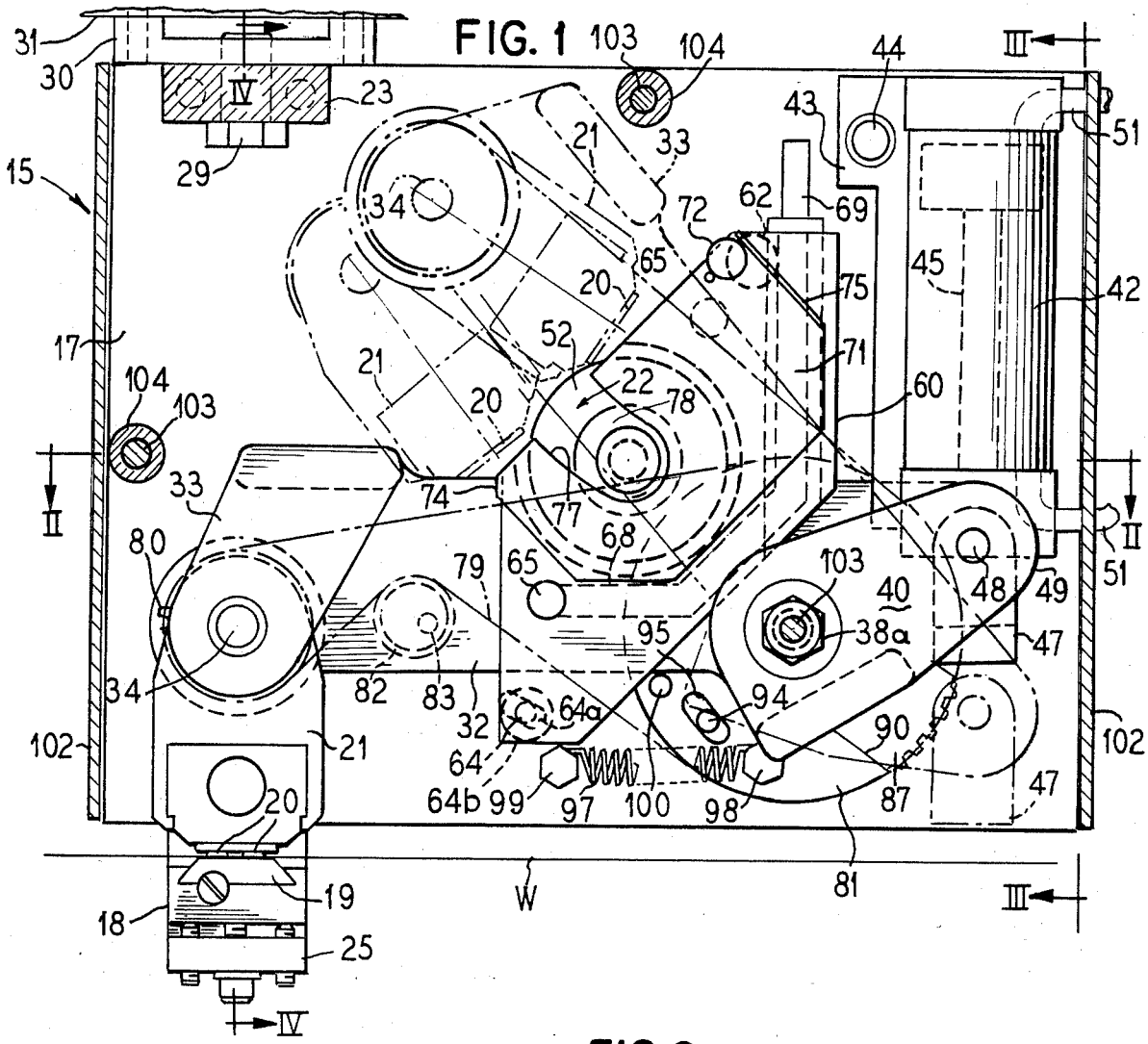
FIG. 1 is a sectional elevational view of a hot ink imprinter embodying aspects of the invention and taken substantially along the line I—I of FIG. 2.

A hot ink imprinter 15 as depicted in FIGS. 1–7 comprises a fairly compact arrangement including a frame panel 17 desirably in the form of a vertical plate supporting on its lower portion means comprising an anvil 18 equipped with a pressure pad 19 on which a workpiece W is adapted to be supported for imprinting by means of type faces 20 carried by a heated print head 21 which is cyclically swingable for effecting ink pickup rolling of the type faces 20 with a rotary hot ink applicator roll 22. The imprinter 15 may be employed to imprint selected areas of what may be preprinted film panels, and is especially useful where the workpiece W is a continuous web or film strip and which may comprise a longitudinally extending series of the panels that may subsequently form individual faces of bags or packages in a packaging or filling machine. In such a machine the work W is generally advanced in a stop and go fashion wherein the panels or areas of the work to be imprinted are moved into position on the anvil 19 while the print head 21 in coordinated relation moves in the inking phase of its operating cycle and then as the workpiece W comes to a stop the print head 21 functions in the imprinting stroke of the cycle.

The frame panel 17 may have secured to its upper margin means for mounting the imprinter 15 in an operating position in or in association with apparatus for processing the workpiece W for whatever purpose desired. As shown, the mounting means includes a bar 23 secured to the panel 17 as by means of bolts 24 and projecting forwardly in generally overhanging relation to the anvil 18 which is mounted on a generally L-shape bracket comprising a horizontal supporting arm 25 underlying the anvil 18 and a vertical arm 28 secured to the back of the frame panel 17 by means of bolts 27 which extend through vertical adjustment slots **27*a* in the arm 28. At substantially a midpoint in its length, the mounting bar 23 may be secured as by means of a bolt 29 to a hanger block 30 secured to a supporting structure 31 which may be part of a machine frame. This manner of mounting the imprinter 15 permits the same to be swivelled about the axis of the bolt 29** for adjustment purposes and will then be held in the adjusted position by tightening of the bolt.

Figure 2:
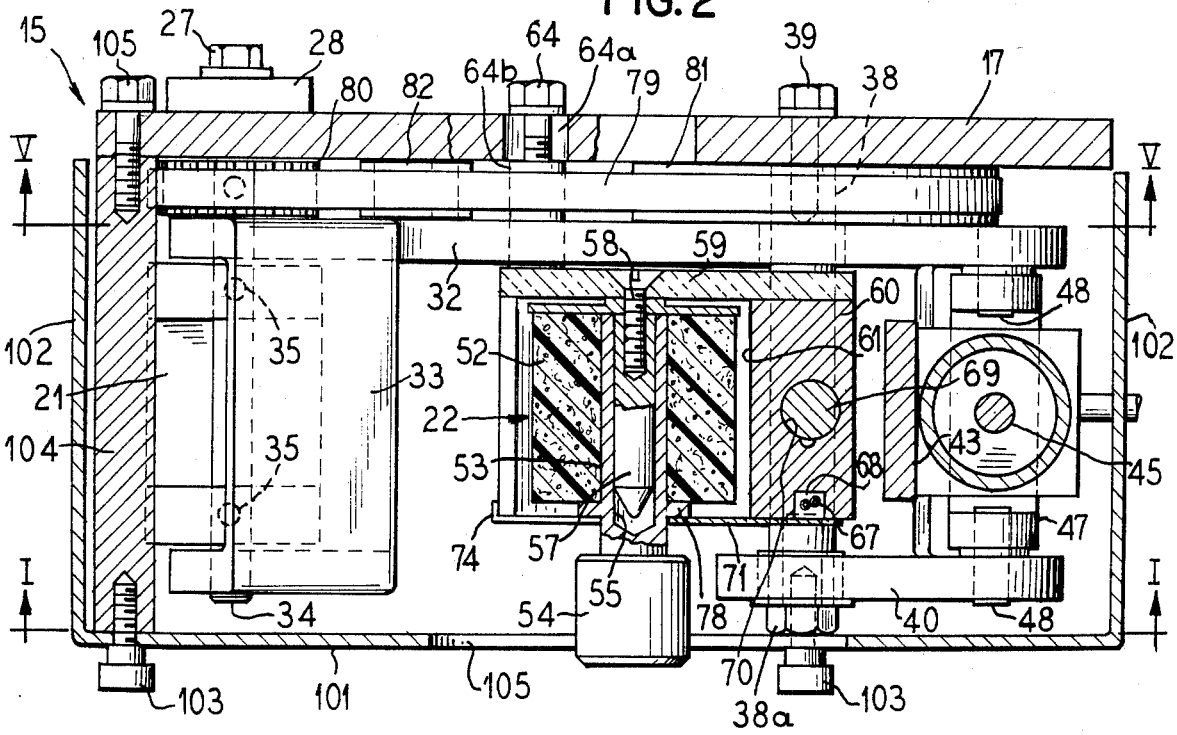
FIG. 2 is a sectional plan view taken substantially along the line II—II in FIG. 1.

In a preferred arrangement, the print head 21 is mounted on one end portion of an operating rocker arm 32 which is elongated in a side-to-side relation as seen from the front of the imprinter 15 in FIG. 1, and is flat in a vertical plane and located in adjacently spaced relation parallel to the frame plate 17 as best visualized in FIG. 2. For supporting the print head 21, the arm 32 has integrally therewith a forwardly projecting and downwardly opening yoke 33 within which the upper portion of the block comprising the print head 21 is received and pivotally supported by means of a shaft 34 journalled in the sides comprising the yoke. Means for fastening the print head 21 corotatively to the shaft 34 may, in one arrangement, comprise set screws 35 which engage flats 37 (FIG. 4) on the shaft 34.

Intermediate its ends, but spaced farther from the print head supporting yoke 33 than from the opposite end of the arm 32, the arm is pivotally mounted to swing about the axis of a shaft 38 which is secured at its rear end fixedly to the frame panel 17 as by means of a screw 39. The shaft 38 is of a length to extend sufficiently forwardly to provide pivotal support for the front side of a yoke 40 integral with the short end portion of the arm 32, the rear side of the yoke being provided by the rear end portion of the arm 32. A retainer bolt **38*a* is secured to the front end of the shaft 38**.

Figure 3:
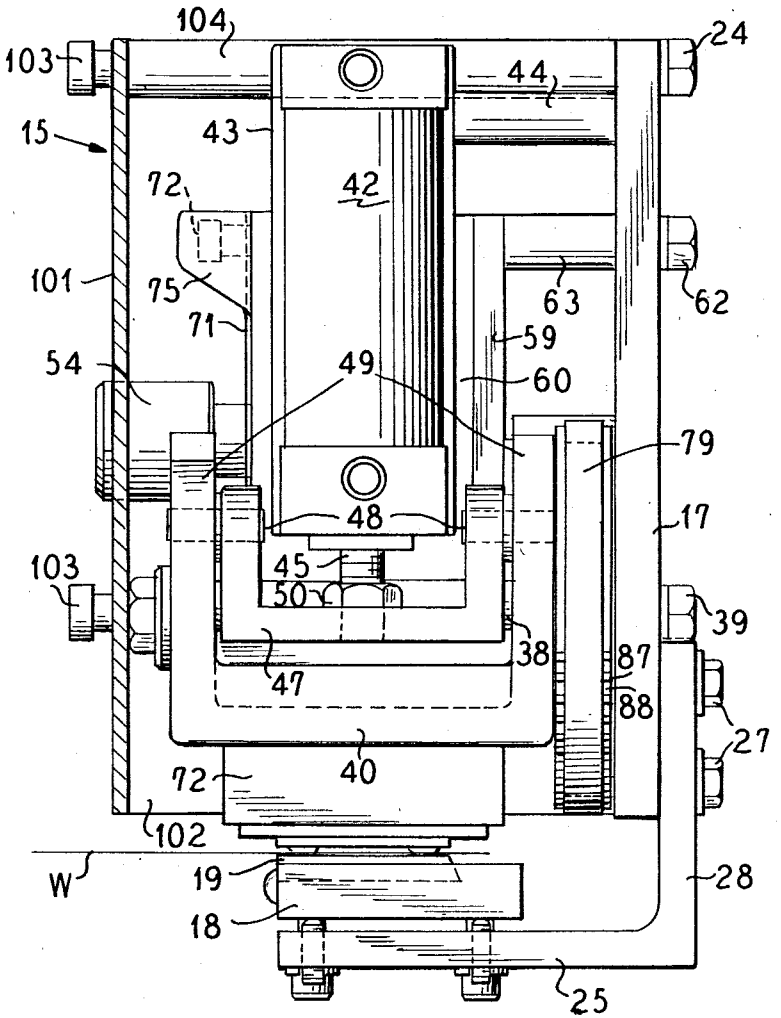
FIG. 3 is a side elevational view, partially in section, taken substantially along the line III—III in FIG. 1.

For rocking the arm 32 about the axis of the shaft 38, means comprising a fluid operated actuator 42, preferably of the pneumatic cylinder type, is mounted above the yoke 40 by means of a mounting bracket 43 pivotally supported on a stud 44 fixed to the frame panel 17. A piston rod 45 projects downwardly from the lower end of the actuator 42, and as best seen in FIG. 3 is threadedly secured to and within another yoke 47 which is mounted within the yoke 40 on trunnions 48 secured to space parallel ears 49 of the yoke 40. The piston rod 45 is releasably locked to the yoke 47 as by means of a locknut 50. For pneumatically operating the actuator 42, compressed air is adapted to be delivered to and exhausted from the actuator in a controlled cycle through ducts 51 communicating with opposite ends of the cylinder of the actuator.

In a preferred construction, the printing ink applicator 22 comprises a freely rotatably mounted porous elastomeric roll 52 (FIG. 2) impregnated with a heat liquifiable inking pigment and provided with a bushing or sleeve hub 53 equipped at its outer end with a manipulating handle 54. In a rearwardly opening blind end bore 55, the hub 53 receives a supporting spindle 57 which is secured as by means of a screw 58 to a rigid heat insulating panel 59 attached to the back side of a heater block 60. A heating chamber cavity 61 in the block 60 accommodates the roll 52 in substantially surrounded relation except for a perimeter of the roll 52, which is exposed at an opening from the cavity oriented in a generally upward and leftward direction as viewed in FIG. 1, for inking cooperation with the print head 21.

Mounting of the heater block 60 on the frame panel 17 is in a position forwardly adjacent to the rocker arm 32 and between and clear of the rocker arm yokes 33 and 40. Attachment of the heater block 60 to the panel 17 is by means of a screw stud 62 (FIGS. 1, 3 and 4) and a spacer 63 adjacent to the upper end of the block and well above the upper limit of the range of rocking movement of the arm 32. Further attachment of the heater block 60 is effected at its lower end by means of a screw 64 extending through an arcuate adjustment slot **64*a* and a spacer 64*b* located below the lower range of movement of the arm 32. For liquifying the ink pigment carried by the inking roll, the block 60 is adapted to be heated by means of a pair of cartridge heaters 65 mounted in suitable sockets in the block, preferably located adjacent diametrically opposite sides of the recess 61 and connected to an electrical energy source by means of electrical wiring 67 (FIGS. 2 and 4) suitably accommodated as by means of a channel 68 in the heater block. A temperature control thermostat 69 may be mounted in bore 70 in the heater block 60**.

For quick releasably retaining the inking roll 52 in the heater block 60, a combination closure and latch plate 71 is mounted on the front face of the heater block 60 and is dimensioned to extend in substantially closing relation across the front opening into the cavity 61. Retention of the latch plate 71 releasably in its latching position, is effected by means of a threaded stud 72 secured to the upper portion of the heater block 60 and providing a pivot for the upper portion of the latch plate. Normally the latch plate 71 is biased into face-to-face abutment with the heater block by means of a compression spring 73 engaged between the latch plate and the head of the stud 72. At its opposite, generally lower end, the latch plate 71 has a short rearwardly turned retaining shoulder flange 74 (FIGS. 1 and 2) which is adapted to engage the end edge of the heater block adjacent to the lower side of the inking roll exposing opening from the heating chamber cavity 61. Opening manipulation of the latch plate 71 is facilitated by means of a forwardly projecting ear-like handle flange 75 located on the upper end of the latch plate adjacent to the mounting stud 72 so that by grasping the handle flange 75 pulling forwardly the spring 73 is adapted to be overcome for shifting the latch plate away from the heater block 60. Thereby the retaining shoulder 74 can be released and the latch plate 71 swung away from the inking roll 72 as permitted by a clearance slot 77 which clears the hub 53, as best seen in FIGS. 1 and 2. In the closed latch position as shown in FIGS. 1 and 2, a collar 78 on the hub 53 spaced from the handle knob 54 is engaged by the latch 71 for retaining the inking roll on the spindle 57. By manually releasing and swinging the latch 71 downwardly and away from the cavity 61, the forward opening from the cavity is opened, permitting the inking roll 22 to be removed and replaced as necessary. As will be apparent, by virtue of the dimensional relationships of the latch 71 and the block 60 as best seen in FIG. 1, when the latch is swung to its fully open position, the shoulder flange 74 is adapted to engage as a detent with the edge of the heater block 60 opposite to that engaged by the flange 74 in the closed latch position, thereby, holding the latch clear of the front opening from the cavity 61. After inking roll replacement has been effected, closing return of the latch 71 is easily effected by manipulating the handle flange 74.

Figure 4:
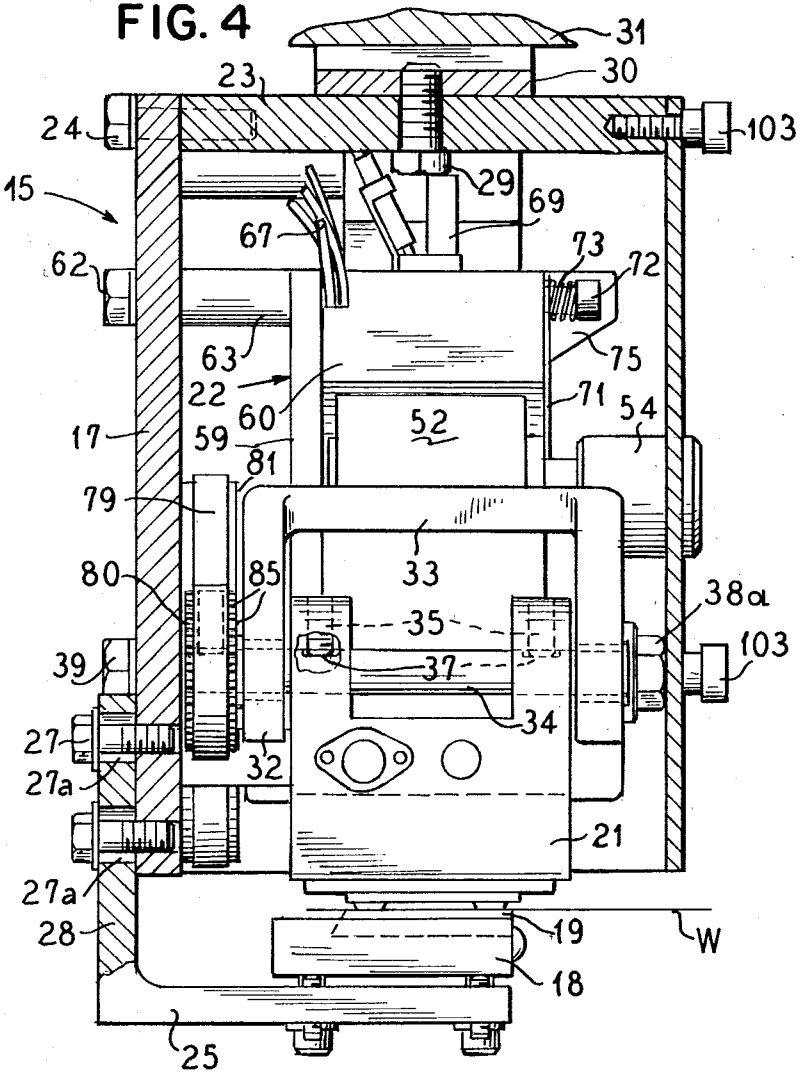
FIG. 4 is a sectional elevational detail view taken substantially along the line IV—IV in FIG. 1.

Means are provided for automatically swinging the printing head 21 cyclically between its imprinting phase or position as shown in full outline in FIG. 1 and an inking phase or position in relation to the inking roll 52, in response to rocking movements of the arm 32. To this end, an endless transmission belt 79 is located in a space provided therefor between the frame panel 17 and the rocker arm 32 (FIGS. 2, 3 and 4). On one hand the transmission belt 79 is trained over a swing pulley 80 keyed to a rearward extension of the shaft 34 to which the print head 21 is also keyed. On the other hand, the belt 79 is trained over a drive pulley 81 which is journalled on the rocker arm shaft 38. Take-up means for the belt 79 comprise an eccentric take-up pulley 82 mounted on a pintle 83 on the back side of the rocker arm 32 (FIGS. 1, 2 and 5).

In a preferred form, the transmission belt 79 is of the timing belt type having internal teeth 84 which mesh with complementary periphery teeth 85 on the swing pulley 80 which is of substantially smaller diameter than the diameter of the drive pulley 81. Although the pulley 81 throughout the major extent of its diameter has a smooth peripheral belt guiding groove, it is provided in a limited segment of its perimeter with a belt-engaging control dog 87 having radially projecting teeth 88 which are complementary to and engage the teeth 84 of the belt 79 at that portion of the perimeter of the pulley 81 which faces generally away from the arm 32. Conveniently, the dog 87 comprises a straight sided member of about the same thickness as the pulley 81 (FIG. 6) and provided with a recess 89 in its rear side adapting the dog for engagement in a complementary radially extending socket in the front face of the pulley 81 and within which the dog is adapted to be anchored by means of a screw 91 extending through a radially elongate adjustment slot 92 in the dog. The head of the screw 91 is accommodated flush with this outer face of the dog 87 in a radial groove 93. Through this arrangement, the dog 87 is adapted to be adjusted radially relative to the pulley 81 to attain proper tensioned engagement with the belt 79, and the dog then locked in place by means of the screw 91.

Figure 5:
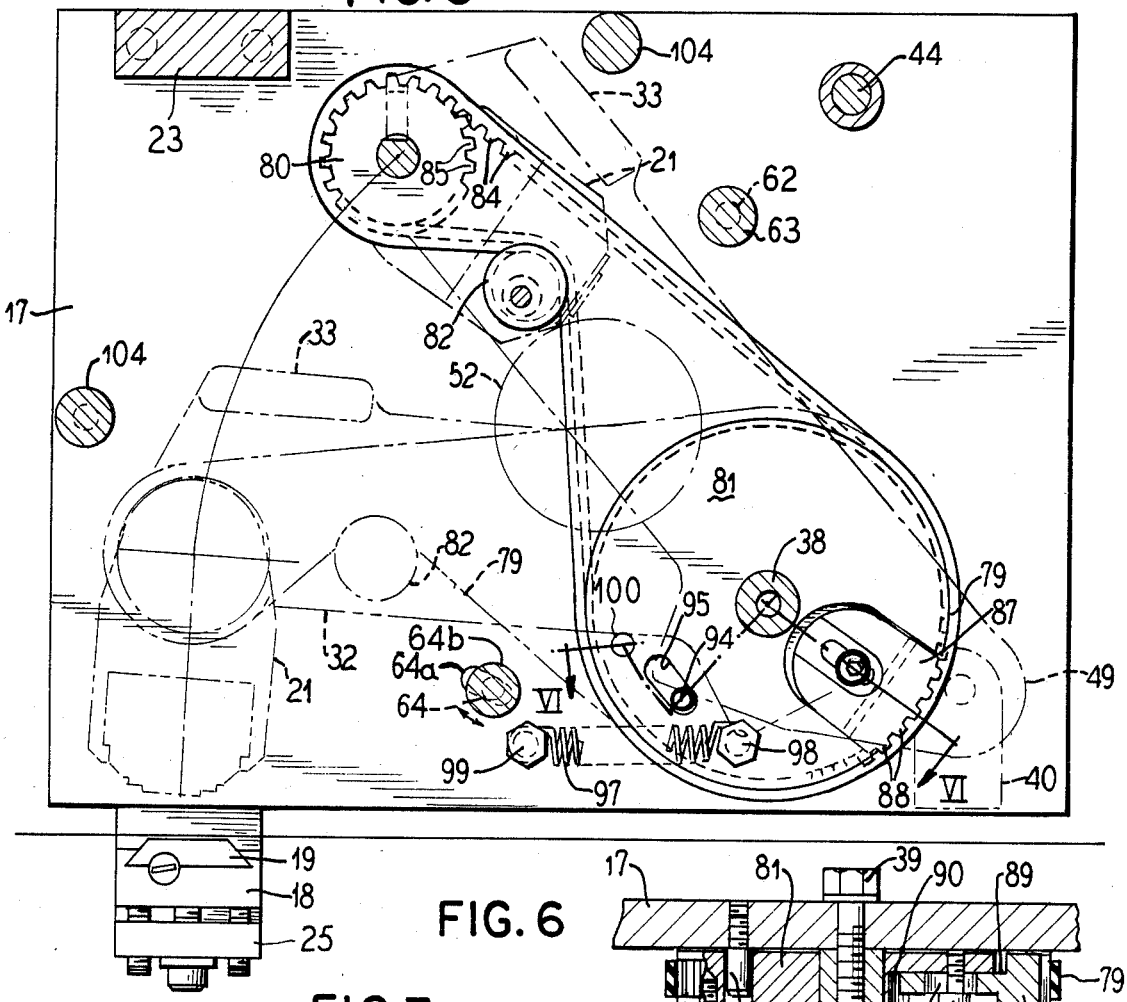
FIG. 5 is a sectional elevational view taken substantially along the line V—V in FIG. 2.
Figure 6:
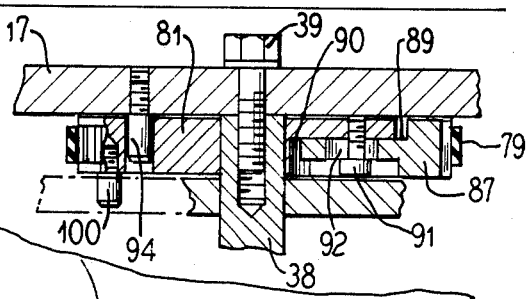
FIG. 6 is a sectional detail view taken substantially along the line VI—VI in FIG. 5.
Figure 7:
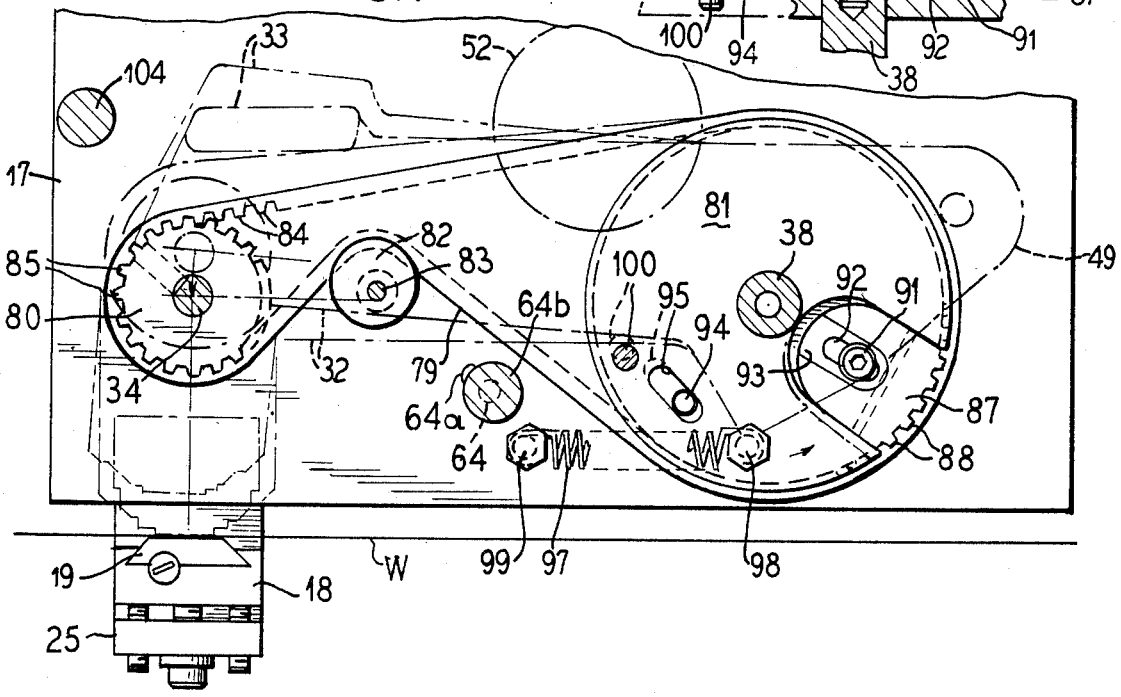
FIG. 7 is a fragmentary sectional elevational view similar to FIG. 5 but showing components in a different operating position.

Means are provided for permitting only a very limited range of rotary movement of the pulley 81 about the shaft 38, such means comprising a stop pin 94 secured to the frame panel 17 and projecting into a circumferentially elongate slot 95 in the pulley 81 and defined by a stop shoulder at its lower end as viewed in FIG. 5. Normally the pulley 81 is biased by means of a tension spring 97 in a clockwise direction for bottoming the pin 94 on the slot shoulder during the inking phase rocking of the arm 32. At one end the spring is secured to an anchor 98 on the pulley 81. At its opposite end the spring is secured to an anchor 99 on the frame plate 17.

In a cycle of operation, the rocker arm 32 is rocked, by operation of the actuator 42, clockwise as viewed in FIGS. 1 and 5 away from the imprinting position, timed with resumption of forward advance of the workpiece W. Since the pulley 81 is held stationary by the stop pin 94, and the belt 79 is held against longitudinal displacement by virtue of the meshed engagement with the control dog 87, as the print head end of the rocker arm 32 rocks upwardly, the swing pulley 80 is controlled by the belt 79 to turn counterclockwise and thereby swing the print head 21 progressively counterclockwise. Then as the arm 32 passes the ink applicator 22, the type faces 20 will be caused to roll in contact with the periphery of the hot ink applicator roll 52 and thus pick up ink therefrom. The range of movement of the arm 32 is such that, on the upstroke, the print head 21 may swing entirely past the inking roll 52, as indicated by the uppermost phantom position of the print head 21 in FIGS. 1 and 5. On reversal rocking of the rocker arm 32, the transmission belt 79 causes the pulley 80 to reverse swinging of the print head 21, that is, causes the print head to swing in the clockwise direction, so that the type faces 20 are again rolled against the inking roll 52 which is for this purpose rotatable in opposite directions responsive to the cyclical swinging rolling of the type faces thereon, thus assuring that the type faces will be thoroughly inked before returning to the imprinting position. As the arm 32 rocks in return stroke, the print head 21 leaves the inking roll and is progessively returned toward the imprinting position, as indicated in the lowermost phantom position of the print head in FIG. 5.

In order to assure straight-on imprinting contact of the type faces 20 against the workpiece W on the anvil 18, and to avoid any problem with smearing as the type faces contact the workpiece W which at the moment of imprinting is stopped on the backup pad 19 of the anvil 18, means are provided for, in effect, cancelling swinging of the print head 21 in the final increment of the imprinting stroke. In a practical arrangement, such cancelling is effected in the last three to five degrees of the imprint stroke. For this purpose, the pulley 81 carries a control pin 100 which is located adjacent to the upper end of the slot 95 and in a position wherein it will be engaged by the arm 32, as shown in FIG. 5, just before the print head 21 reaches the imprinting position. Then as the arm 32 advances in the imprinting stroke, the pulley 81 is caused to turn counterclockwise with the arm 32, in opposition to the biasing spring 97, whereby to stop any further return swinging of the print head relative to the arm 32. This results in precise, smearfree, imprinting contact with the workpiece W in the final increment of the imprinting stroke, as shown in the lowermost phantom outline of the print head in FIG. 7.

During normal operation, the imprinter 15 is desirably enclosed in a generally U-shaped shield having a front wall 101 and opposite side wall 102. Readily removable attachment of the shield is adapted to be effected by securing the front wall 101 in place as by means of digitally manipulatable screws 103 threaded into front ends of support rods 104 attached at their rear ends as by means of screws 105 to the frame panel 17. Additional attachment of the wall 101 may be effected by means of one of the collar screws 103 secured into a threaded bore in the retaining bolt 38*a* at the front end of the shaft 38. Access to the ink applicator 22, and more particularly the latch plate 71 and the manipulating handle knob 54 is permitted through an opening 105 in the front wall 101.

Figure 8:
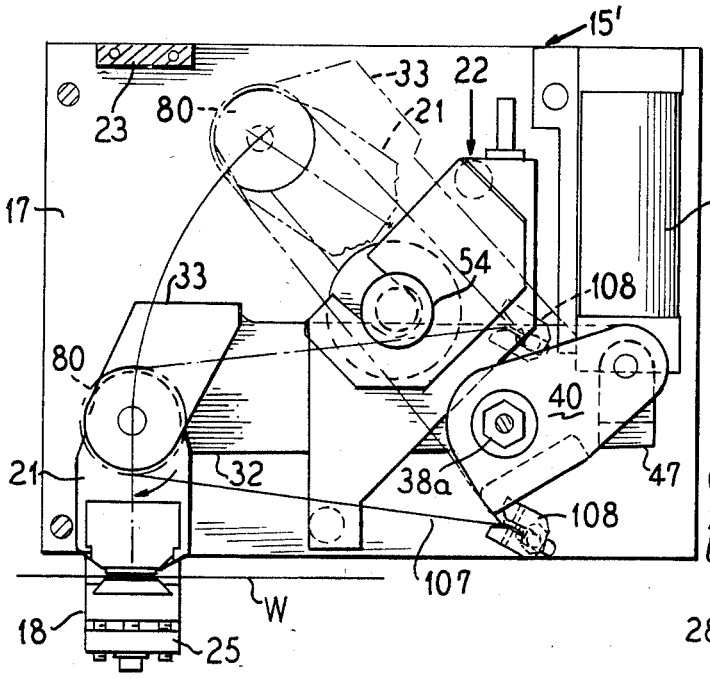
FIG. 8 is a front elevational view of a modification of the hot ink imprinter of the present invention.

Although the transmission belt driving arrangement described in connection with the imprinter 15 of FIG. 1 provides especially advantageous mechanical advantage for controlling cyclical operation of the print head 21, a modified arrangement of the motion transmission belt as depicted in FIG. 8 in connection with the imprinter 15' may be utilized. In this embodiment of the imprinter, all of the parts which are identified by the same reference characters as in FIG. 1 may be of substantially the same construction and function in substantially the same manner, and therefore the description thereof will not be repeated. However, instead of an endless flexible toothed timing belt, the imprinter 15' provides for a toothed flexible belt 107 which is secured at its opposite ends to anchors 108 mounted on the front face of the frame panel 17. One of the anchors 108 is mounted at a lower portion of the panel 17 below the pivot for the arm 32, and the other of the anchors 108 is mounted above the arm pivot, and the ends of the belt 107 being in substantially vertical alignment along an axis normal to the arm pivot axis. The arrangement is such that as the arm 32 is caused to swing in its operating cycle by means of the actuator 42, the anchored belt 107 will drive the pulley 80 in substantially the same fashion as already described for swinging the print head 21 through its cyclical printing and inking phases.

Figure 10:
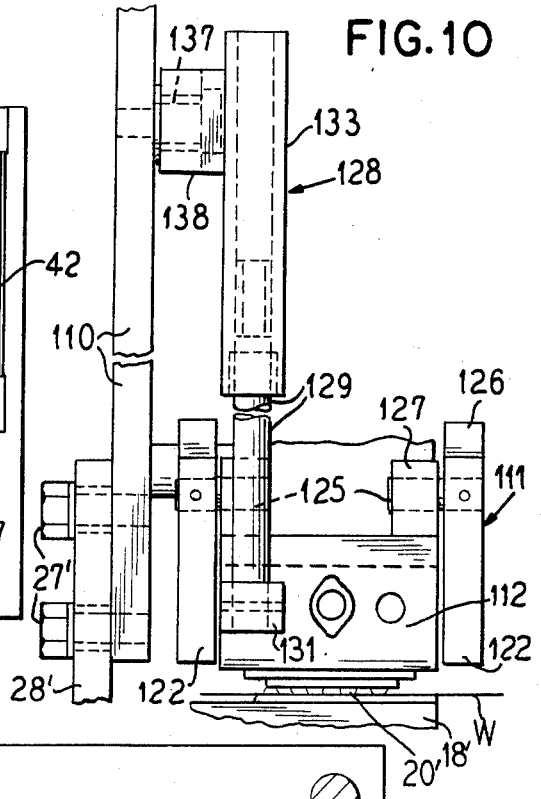
FIG. 10 is a fragmental elevational view taken substantially along the line X—X in FIG. 9.
Figure 9:
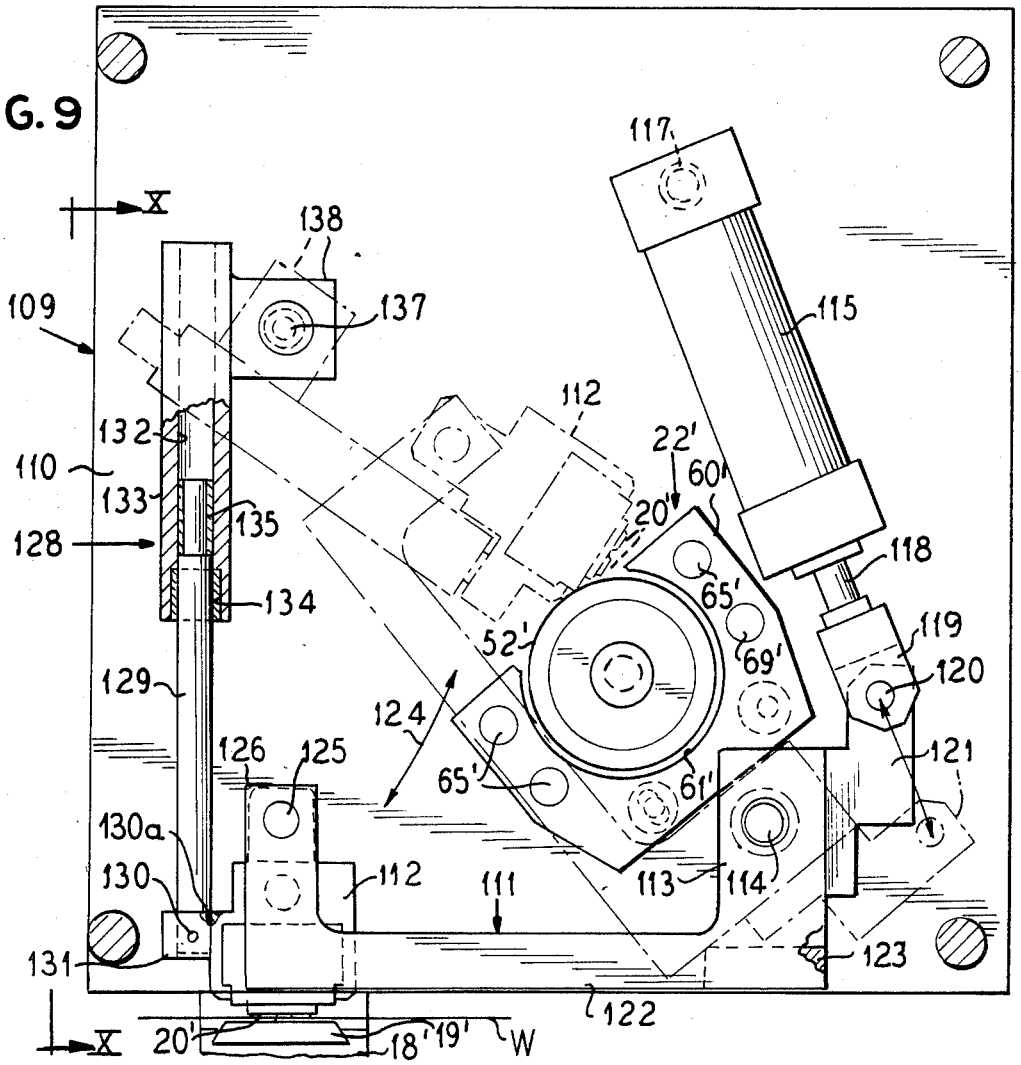
FIG. 9 is a front elevational view of another modification.
Figure 11:
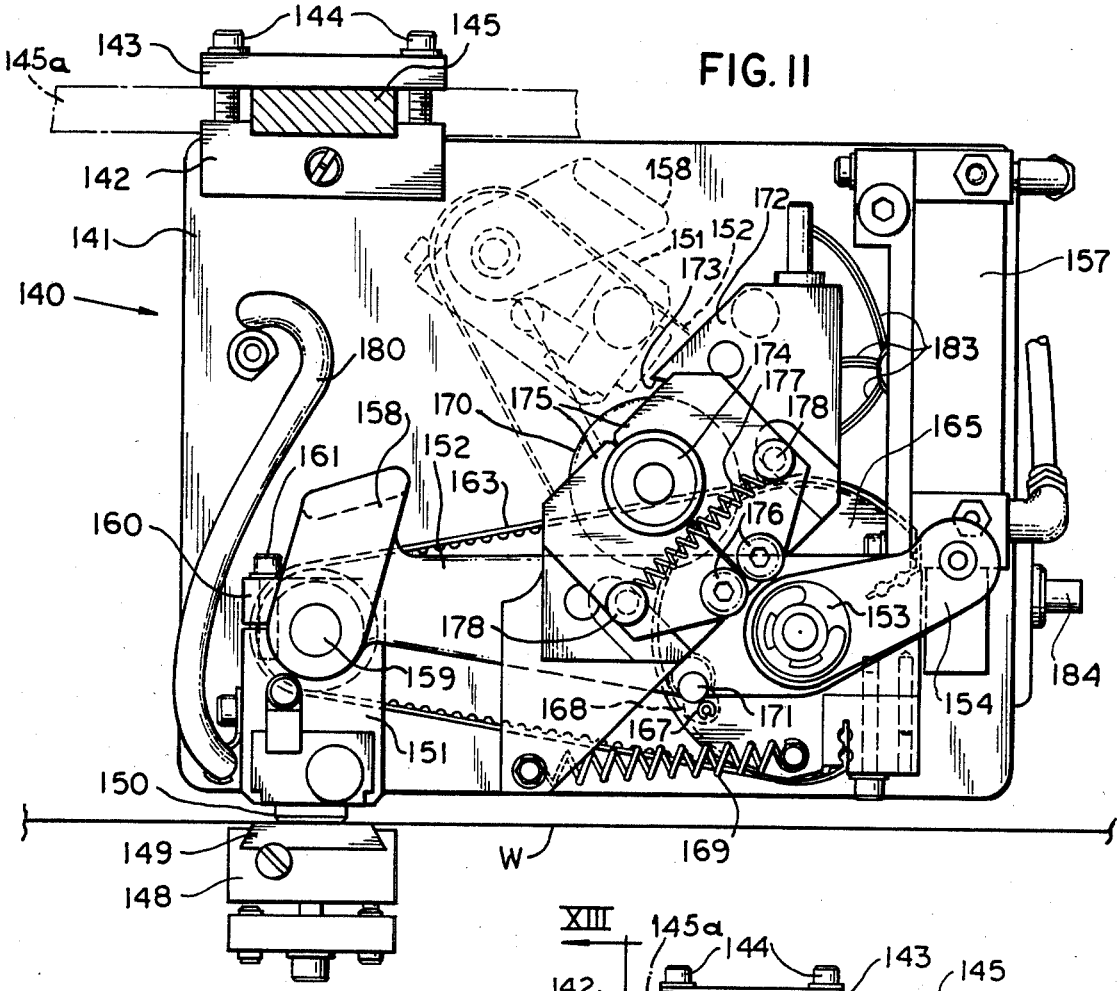
FIG. 11 is a front elevational view of still another modification of the hot ink imprinter of the present invention.
Figure 12:
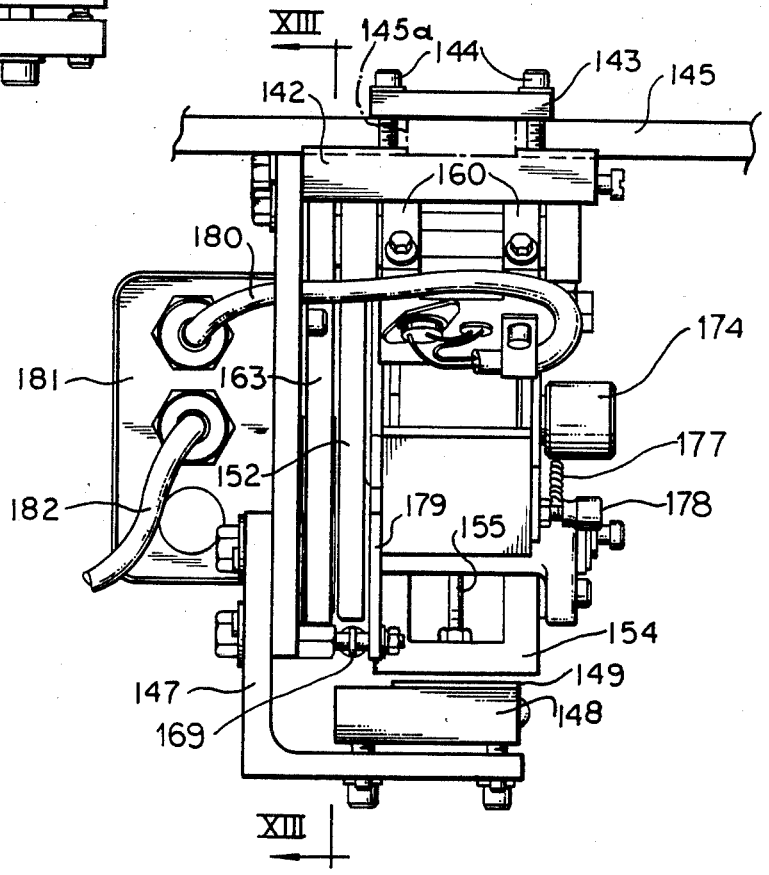
FIG. 12 is a left side elevational view of the same.

In another modified arrangement as shown in FIGS. 9 and 10, the imprinter 109 provides for mechanical swinging of the print head through its operating cycle. In this embodiment, a mounting frame panel 110 has a generally L-shaped rocker arm 111, the long arm of which extends generally horizontally and supports a print head 112 at one end, while the opposite end of the long arm carries a shorter upstanding arm 113 which is intermediately pivotally attached to the frame panel 110 by pivot means 114. Rocking actuation of the arm 111 about the pivot 114 is adapted to be effected by means of a cylinder and piston actuator 115 desirably of the pneumatic type attached at its upper end to the panel 110 and by pivot means 117 and having its piston rod 118 attached as by means of a clevis 119 and pivot means 120 to upstanding ear means 121 projecting upwardly on the short arm 113 and offset from the pivot 114 in a direction away from the long arm portion of the rocker arm.

In a preferred construction, the rocker arm 111 comprises spaced parallel bar elements 122 having their major plane vertical. The elements 122 are connected together adjacent to the juncture of the long arm and short arm portions of the bar 111 by means of a cross bar structure 123. Spacing of the bar elements 122 is sufficient to clear therebetween the inking device 22' of similar construction as the inking device 22 of FIG. 1 and comprising a heater block 60' mounted on the panel 110 in the same manner as the heater block 60 in FIG. 1. Cartridge heaters 65' and a thermostat 69' are adapted to be carried by the heater block 60' and a heating chamber 61' accommodates an ink pigment impregnated inking roll 52', similarly as described for the inking roll 52 in FIG. 1. Orientation of the inking roll 52' is such that the print head 112 is adapted to be swung, by actuation of the arm 111 cyclically as indicated by the arrow 124 through imprinting and inking phases of operation. In the imprinting position of the print head 112 type faces 20' contact in printing relation with the workpiece W resting on the pressure pad 19' of the anvil 18' which, similarly as described for the anvil 18 in FIG. 1, is attached in vertically adjustable relation to the frames panel 110 by means of a bracket 25' and screws 27'.

Mounting of the print head 112 swingably between the rocker arm elements 122 is effected by means of trunnions 125 projecting toward one another fixedly from upstanding ears 126 on the adjacent ends of the bar elements 122. Upstanding swing lugs 127 on the print head 112 are journalled on the trunnions 125. Desirably the print head 112 carries heater and thermostat means similarly as the print head 21 in FIG. 1.

For controlling swinging of the print head 112 in response to rocking of the arm 111, mechanical means in the form of an upstanding telescopic link controller 128 is provided. This comprises a control rod 129 which has its lower end fixedly attached by means of a pin 130 in an upwardly directed socket 130*a* in a boss 131 extending from the block of the print head 112 in direction away from the arm 111. From the boss 131, the control rod 129 projects upwardly and is telescoped into a bore 132 of a sleeve-like control cylinder 133. For smooth, free relative telescopic movement of the rod 129 and the cylinder 133, frictionless bearing means such as a nylon or polytetrafluoroethylene bushing bearing 134 is mounted in the entrance portion of the bore 132 of the cylinder 133 and a bushing bearing 135 of similar material is mounted on the head end of the rod 129. Swingable mounting of the cylinder 133 on the frame panel 110 is effected by means of a pivot pin bolt 137 journalling a bearing block 138 integral with the upper portion of the cylinder 133, and with the journal axis desirably aligned in a vertical plane above the swing journal axis of the print head 112 in its printing position as observed in full line in FIG. 9. The arrangement is such that as the arm 111 rocks upwardly about its pivot 114, the rod 129 telescopes into the cylinder 133. As the print head 112 is raised, it is caused to to swing in an arc for rolling ink application contact of the type faces 20' on the perimeter of the inking roll, similarly as described for the inking action of the print head 21 in FIG. 1. That is, as the print head 112 swings toward its maximum upward position in the inking stroke, the type faces 20' are caused to roll generally upwardly along the perimeter of the rotatably mounted inking roll 52', and as the arm 111 is moved in the return direction, the type faces 20' are caused to roll in generally downward direction on the perimeter of the inking roll 52'.

Straight-on inking impact of the type faces 20' against the workpiece W on the anvil 18' in the inking stroke of the head 112, is assured by the orientation and attachment of the swing control rod 129 to the print head block through the boss 131.

Referring to FIGS. 11–15, an imprinter 140 is depicted, which in many respects is similar to the imprinter 15 of FIGS. 1–7. In this embodiment of the invention, a mounting frame panel 141 has on its upper end a forwardly projecting mounting bar 142 adapted to be secured by means of a clamping plate 143 and screws 144 alternatively to a front to rear supporting bar 145 or a side-to-side bar 145*a* of a machine frame for supporting the imprinter 140 in printing relation to the web W.

Similarly as in FIG. 1, the frame panel 141 carries on its lower end a generally L-shaped bracket 147 supporting an anvil 148 carrying a pad 149 over which the web W advances for imprinting by means of type face 150 carried by a printing head 151 mounted pivotally on one end of a rocker arm 152 mounted on a pivot shaft 153 carried by the panel 141 and having a yoke 154 to which is connected a downwardly extending piston rod 155 of a pneumatic cylinder actuator 157 which is mounted on the frame panel 141 at the opposite end from the print head 151. For pivotally mounting the head 151 on the arm 152, the arm is provided with a yoke 158 carrying a pivot pin or shaft 159 which is rotatable in the yoke and to which the upper end of the print head 151 is secured fixedly by means of clamps 160 releasably secured by means of bolts 161 so that the proper printing attitude of the print head 151 is adapted to be accurately adjusted.

Fixedly attached to the shaft 159 is a relatively small diameter toothed swing pulley 162 over which is trained a flexible transmission belt 163 having internal teeth 164 which mesh with the teeth of the pulley 162. From the pulley 162, the belt 163 extends to a larger diameter drive pulley 165 which is rotatably mounted on the shaft 153. The pulley 165 is provided with a smooth peripheral guide groove in which the transmission belt 163 partially wraps the drive pulley 165 at substantially diametrically opposite sides thereof. Ends of the belt 163 are anchored under tension to the pulley 165, as shown.

Rotation of the pulley 165 about the shaft 153 is restrained to a limited arc of movement by means of a pin 167 (FIG. 14) which extends to a substantial extent beyond opposite faces of the pulley 165. At the rear face of the pulley 165 the pin 167 extends through an elongate movement limiting aperture 168 in the frame panel 141. Normally the pulley 165 is biased by means of a tension spring 169 toward the upper end of the slot 168 (FIG. 13). From this limit stop position of the pin 167, assumed when the rocker arm 152 has been driven by the actuator 157 counterclockwise as viewed in the drawings to effect swinging of the print head 151 into inking relation to ink applicator roll 170. When the rocker arm 152 is swung counterclockwise to return the print head 151 to the imprinting position, a resilient bumper 171 (FIG. 11) carried by the arm engages the portion of the pin 167 which projects from the front face of the pulley 165, and turns the pulley 165 counterclockwise a short distance in opposition to the biasing spring 169 toward the lower end of the slot 168.

Mounting of the inking roll 170 is effected similarly as described in connection with the inking roll 52 in FIG. 1. A heater block 172 is mounted on the frame panel 141 and the inking roll 170 is mounted in a suitable roll chamber cavity 173 in the block 172 with the perimeter of the inking roll exposed for ink application engagement by the type face 150 of the printing head 151. A roll manipulating handle knob 174 projects coaxially from the outer side of the inking roll 170 and is cooperatively related to means for retaining the inking roll 170 operatively in the cavity 173, and comprising a pair of cooperative identical gate plates 175 pivotally mounted by means of adjacent pivots 176 to the block 172 diametrically opposite to the exposed perimeter of the roll 170. Normally the plates 175 are drawn toward one another into inking roll latching and roll chamber closing relation by means of a light tension spring 177 anchored at opposite ends to respective manipulating handle knobs 178 carried by the latch plates and adapted to be manipulated for opening the latch plates against the tension of the spring 177 when it is desired to mount or remove the inking roll 170. Projecting generally downwardly from the block 172 is an anchor flange 179 to which an end of the biasing spring 169 is anchored, the opposite end of this spring being anchored to the pulley 165.

Both of the print head 151 and the heater block 172 are provided with electrically activated heater means and controls. A flexible electrical connection 180 connects the print head 151 through a junction box 181 which is connected by means of a lead 182 with an electrical power source. Electrical leads 183 connect the heaters and associated thermostat associated with the heater block 172 with the junction box 181. A control switch 184 (FIG. 11) may be provided on the junction box 181 for turning the electrical current on and off simultaneously for both of the print head 151 and the heater block 172.

Operation of the hot ink imprinter 140 is similar to that of the imprinter 15 of FIG. 1. From the imprinting stroke of the print head 151 as represented in full outline in FIG. 11, the print head is adapted to be swung up in an inking stroke as represented in dash outline in FIG. 11. As the print head 151 is swung upwardly, the drive belt 153 which is anchored at its opposite ends to the pulley 165 operates through the print head controlling pulley 162 to swing the print head 151 to and in inking relation to the inking roll 170, the imprinting type means 150 rolling on the perimeter of the inking roll on the upsweep, and then again rolling on the inking roll perimeter on the downsweep, indicated in FIG. 13. In the final increment of downward movement of the print head 151, the rocker arm carried bumper 171 presses against the pin 167 as indicated in dash outline in FIG. 13 and full line in FIGS. 11 and 14, causing the drive pulley 165 to rotate a limited distance counterclockwise whereby to effect swinging of the print head 151 into a square, straight-on imprinting relation to the anvil 148 and thereby to the web W on the pressure pad 149.

In all embodiments of the invention suitable electrical and penumatic controls may be provided for controlling the various heating elements and for controlling operation of the actuators of the imprinters. Such operation controlling is desirably effected in complementary and coordinated relation to operation of the apparatus with which the imprinter is associated, and in particular in coordinated relation with stop and go travel control of the workpiece W.

It will be understood that variations and modifications may be effected without departing from the spirit and scope of the novel concepts of this invention.

I claim as my invention:

1. A hot ink imprinter, comprising:

anvil means for supporting a workpiece to be imprinted;

a rotatably mounted free-wheeling hot ink applicator roll;

an elongate operating rocker arm having two end portions and mounted on a pivot intermediate said end portions of the arm;

actuator means attached to one end portion of said arm for rocking said arm cyclically about said pivot intermediate said end portions;

a print head carrying imprinting means and mounted swingably on the opposite end portion of said arm;

a pulley mechanism including a timing belt connecting said arm and said actuator means for causing said print head to swing back and forth cyclically toward and past said arm as said arm is rocked for, in a first phase of the cycle causing said imprinting means to roll on said hot ink applicator roll in a first direction for applying ink to said imprinting means, in a second phase of the cycle causing said imprinting means to roll on said hot ink applicator roll in a second opposite direction with said hot ink applicator roll thereafter freely rotating for randomly orienting a portion thereof for a next roll of said imprinting means thereon, and in a third phase of the cycle effecting imprinting of the workpiece on said anvil means.

2. An imprinter according to claim 1, wherein said opposite end portion of said arm has thereon a yoke, and means pivotally mounting said print head within said yoke.

3. An imprinter according to claim 1, wherein said rocker arm has a first yoke at said one end portion, and a second yoke carried pivotally by and within said first yoke and having said actuator means attached within the second yoke.

4. An imprinter according to claim 1, including a frame means having a face on which said pivot is mounted, said pivot comprising an axle extending from said frame means carrying said rocker arm in space relation from said frame means, and said timing belt and pulley mechanism being located in the space between said face of said frame means and said rocker arm.

5. An imprinter according to claim 1, wherein said pulley mechanism comprises a first pulley mounted coaxially with said pivot, means for retaining said first pulley against any substantial rotation relative to said pivot, a second pulley mounted corotatively with said print head, said timing belt connecting said pulleys, and means for holding said timing belt substantially against running displacement relative to said first pulley.

6. An imprinter according to claim 5, including a lost motion connection carried on said first pulley disposed for engaging said arm for a portion of said third phase causing said first pulley and said arm to move as a unit and thereby ceasing swinging of said pivot head during imprinting to assure a smear-free imprinting stroke of said printing head.

7. An imprinter according to claim 6 wherein said lost motion connection comprises a pin projecting axially from said first pulley and disposed for abutting said arm as said first pulley rotates during said portion of said third phase.

8. An imprinter according to claim 1, wherein said pulley mechanism comprises a pulley corotative with said print head, and said timing belt is fixedly anchored at opposite ends of said rocker arm pivot independently of said rocker arm and trained over said pulley.

9. An imprinter according to claim 1, including a heater block having a cavity therein for accommodating said applicator roll, means for mounting said block in a fixed position relative to said rocker arm, means within said cavity for mounting said applicator roll removably, a latch plate means mounted swingably on said block in releasable retaining relation to said applicator roll, means for biasing said plate means against said block, a handle on said plate means for manipulating the plate in opposition to said biasing means and for swinging the plate between a latching and a non-latching position, and detent means for retaining said plate means selectively in the latching position or in the non-latching position.

10. A hot ink imprinter, comprising:

a print head carrying marking means;

anvil means;

a rotary hot ink applicator roll spaced from said anvil means and rotatable in opposite directions;

a heater block having a cavity therein for accommodating said applicator roll;

means for mounting said block in a fixed position relative to said means for cyclically swinging said print head;

means within said cavity for mounting said applicator roll removably;

a latch plate mounted swingably on said block for releasably retaining said applicator roll;

means for biasing said plate against said block;

a handle on said plate for manipulating the plate in opposition to said biasing means and for swinging the plate between a latching and a non-latching position;

detent means for retaining said plate selectively in the latching position or in the non-latching position;

and means for cyclically swinging said print head in opposite directions for in one swinging direction of the head effecting ink pickup rolling engagement of said marking means with said applicator roll and rotation of the roll in that direction, and then in the opposite swinging direction of the head again effecting ink pickup rolling engagement of said marking means with said applicator roll and thereby rotation of the roll in such opposite direction, and in the continuation of the opposite swinging direction causing the head to leave the roll for effecting imprinting engagement of said marking means with a workpiece on said anvil means.

11. An imprinter according to claim 10, wherein said means for cyclically swinging said print head comprises a rocker arm which is intermediately pivoted and has means at one end for swingably supporting said print head, and means at the opposite end of said arm for actuating said arm rockably about its pivot.

12. A hot ink imprinter, comprising:

anvil means for supporting a workpiece to be imprinted;

a rotatably mounted hot ink applicator roll;

an elongate operating rocker arm mounted on a pivot adjacent to one end portion of the arm;

actuator means attached to said one end portion of said arm for rocking said arm cyclically about said pivot;

a print head carrying imprinting means and mounted swingably on the opposite end portion of said arm;

means operative in the rocking of said arm by said actuator means for causing said print head to swing back and forth cyclically for, in one phase of the cycle causing said imprinting means to roll on said hot ink applicator roll for applying ink to said imprinting means, and in a second phase of the cycle effecting imprinting of the workpiece on said anvil means;

and said means operative in the rocking of said arm for causing said print head to swing back and forth cyclically comprising a timing belt and pulley mechanism.

13. A hot ink imprinter, comprising:

anvil means for supporting a workpiece to be imprinted;

a rotatably mounted hot ink applicator roll;

an elongate operating rocker arm mounted on a pivot adjacent to one end portion of the arm;

actuator means attached to said one end portion of said arm for rocking said arm cyclically about said pivot;

a print head carrying imprinting means and mounted swingably on the opposite end portion of the said arm;

means operative in the rocking of said arm by said actuator means for causing said print head to swing back and forth cyclically for, in one phase of the cycle causing said imprinting means to roll on said hot ink applicator roll for applying ink to said imprinting means, and in a second phase of the cycle effecting imprinting of the workpiece on said anvil means;

said means operative in the rocking of said arm for causing said print head to swing back and forth cyclically comprising a first pulley mounted coaxially with said pivot;

means for retaining said first pulley against any substantial rotation relative to said pivot;

a second pulley mounted corotatively with said print head;

timing belt means connecting said pulleys;

and means for holding said belt means substantially against running displacement relative to said first pulley.

14. A hot ink imprinter, comprising:

a print head carrying marking means;

anvil means;

a rotary hot ink applicator roll spaced from said anvil means;

means for cyclically swinging said print head for ink pickup rolling engagement of said marking means with said applicator roll and then imprinting engagement of said marking means with a workpiece on said anvil means;

a heater block having a cavity therein for accomodating said applicator roll;

means for mounting said block in a fixed position relative to said means for cyclically swinging said print head;

means with said cavity for mounting said applicator roll removably;

a latch plate mounted swingably on said block for releasable retaining relation to said applicator roll;

means for biasing said plate against said block;

a handle on said plate for manipulating the plate in opposition to said biasing means and for swinging the plate between a latching and a non-latching position;

and detent means for retaining said plate selectively in the latching position or in the non-latching position.

15. A hot ink imprinter comprising:

an anvil means for supporting a workpiece to be imprinted;

a rotatably mounted free-wheeling hot ink applicator roll;

an elongate operating rocker arm having two end portions and mounted on a pivot intermediate said end portions of the arm;

actuator means attached to one end portion of said arm for rocking said arm cyclically about said pivot intermediate said end portions;

a print head carrying imprinting means and mounted swingably on the opposite end portion of said arm;

a telescopic link connected at one end to said print head and pivotal mounting means connecting the opposite end of said link in a pivotal position spaced from said head and arm and applicator roll for causing said print head to swing back and forth cyclically toward and past said arm as said arm is rocked for, in a first phase of the cycle causing said imprinting means to roll on said hot ink applicator roll in a first direction for applying ink to said imprinting means, in a second phase of the cycle causing said imprinting means to roll on said hot ink applicator roll in a second opposite direction with said hot ink applicator roll thereafter freely rotating for randomly orienting a portion thereof for a next roll of said printing means thereon, and in a third phase of the cycle effecting imprinting of the workpiece on said anvil means.

* * * * *